United States Patent [19]

McSweeney

[11] 4,413,442

[45] Nov. 8, 1983

[54] THREE DIMENSIONAL TRANSFORMABLE TOY

[76] Inventor: Andrea McSweeney, 100 Morningside Dr., New York, N.Y. 10027

[21] Appl. No.: 330,963

[22] Filed: Dec. 15, 1981

[51] Int. Cl.[3] ..... A63H 3/00

[52] U.S. Cl. ..... 46/151

[58] Field of Search ..... 46/151, 152, 153, 154, 46/158, 159, 160, 162, 156, 124, 123, 115; 2/185 R, 199

[56] References Cited

U.S. PATENT DOCUMENTS

| | | | |
|---|---|---|---|
| 1,437,467 | 12/1922 | Dykman | 46/151 X |
| 2,325,750 | 8/1943 | De Vries | 46/153 |
| 3,831,316 | 8/1974 | Weistrop | 46/153 |
| 3,864,871 | 2/1975 | Kaelin | 46/154 |
| 4,236,263 | 12/1980 | Allee | 46/152 X |

*Primary Examiner*—Mickey Yu

*Attorney, Agent, or Firm*—Amster, Rothstein & Engelberg

[57] ABSTRACT

A three dimensional toy includes juxtaposed first and second surfaces. The surfaces contain a discontinuity therethrough. Affixed to the second surface are a plurality of figure-forming elements. The toy is transformable from the first configuration to the second configuration and vice-versa. The transformation is performed by causing the bulk of the toy to pass through the discontinuities in the surfaces. When the toy is in the first configuration, the first surface is on the outside of the toy and the second surface with its affixed figure forming elements is hidden from view within the first surface. When the toy is in its second configuration, the first surface is located within the toy and the second surface with its affixed figure-forming elements is positioned outwardly from the first surface and exposed to view. The discontinuities through the surfaces are closed when the toy is in either its first or second configuration and are open during the transformation from one configuration to the other configuration.

8 Claims, 8 Drawing Figures

THREE DIMENSIONAL TRANSFORMABLE TOY

The present invention relates generally to three dimensional transformable toys, and in particular to a three dimensional toy which is transformable from a first configuration in which various elements of the toy are hidden from view to a second configuration in which elements hidden in the first configuration are exposed to view.

Various toys have been available for use by children in which the toy in at least one form resembles an animal-type figure. An example of one such toy is shown in U. S. Pat. No. 3,501,862 (the '862 patent). The '862 patent describes a stuffed toy animal with a removable skin portion which fits over the stuffed animal. U. S. Pat. No. 3,831,316 (the '316 patent) describes a pliant toy bag with a number of fanciful figures placed thereon. Around the periphery of each of the fanciful figures is a conventional zipper fastening. Three dimensional fanciful figures resembling animals are formable by using the pliable bag and zippers.

While the foregoing toys have play value and have proven interesting to children, further excitement, interest and enhanced play value could be generated by providing a child with a three dimensional toy that quickly and easily can be converted by the child from a first unadorned configuration to a second adorned configuration, the second adorned configuration such that the toy resembles a fanciful figure appealable to a child. The toy is constructed such that is can be easily manipulated by a small child and transformed from one configuration to the second configuration by the child. The toy contains no elements that are difficult for a child to manipulate and further contains no sharp or otherwise potentially harmful portions.

It is an object of the present invention to provide a toy of the type described which provides greater play value than prior art toys.

It is another object of the present invention to provide a safe and easily manipulatable three dimensional toy which is transformable from a first configuration in which certain elements of the toy are hidden from view to a second configuration in which the elements hidden in the first configuration are exposed to view, the transformation from first to second configuration and vice-versa being easily accomplished by a child.

Yet another object of the present invention is to provide a toy of the type described wherein the toy contains means for defining an opening and in which the transformation from one configuration to the other configuration is performed by causing the bulk of the toy to pass through the means for defining an opening.

Still a further object of the present invention is to provide a toy which in its first configuration is generally egg-shaped and which in its second configuration resembles an animal which is hatched from an egg to thereby demonstrate to a child the relationship between an egg and an animal.

Broadly, the toy of the present invention may include juxtaposed first and second surfaces with means defining an opening through said two juxtaposed surfaces. A plurality of figure-forming elements are affixed to the second surface. The toy is transformable from a first configuration to a second configuration, the transformation performed by causing the bulk of the toy to pass through the means for defining an opening. When the toy is in its first configuration, the first surface is on the outside of the toy and its second surface with its attached figure-forming elements is hidden from view within the first surface. When the toy is in its second configuration, the first surface is located within the toy and the second surface with affixed figure-forming elements is positioned outwardly from the first surface and is exposed to view.

These two configurations provide the toy with an element of surprise that is appealing to young children. Similar to the childhood game of "PEEK-A-BOO" the child can cause elements of the toy to appear and disappear at will.

In accordance with a specific embodiment of the present invention, the figure forming elements are shaped and dimensioned so as to form a fanciful animal figure. A child can easily convert the toy from its first configuration in which the toy is a closed ovid which resembles an egg to its second configuration in which the toy is an adorned piece which resembles the fanciful animal figure by passing the bulk of the toy through the means for defining an opening.

The toy includes closing means attached to the means for defining an opening for closing same. When the toy is in either its first or second configuration, the means for defining an opening is closed with the closing means. When the toy is being transformed from its first to its second configuration, the means for defining an opening is open.

The above brief description as well as further objects, features and advantages of the present invention will be more fully understood by reference to the following detailed description of the presently preferred, nonetheless, illustrative embodiment in accordance with the present invention when taken in conjunction with the accompanying drawings wherein.

Figure 1:
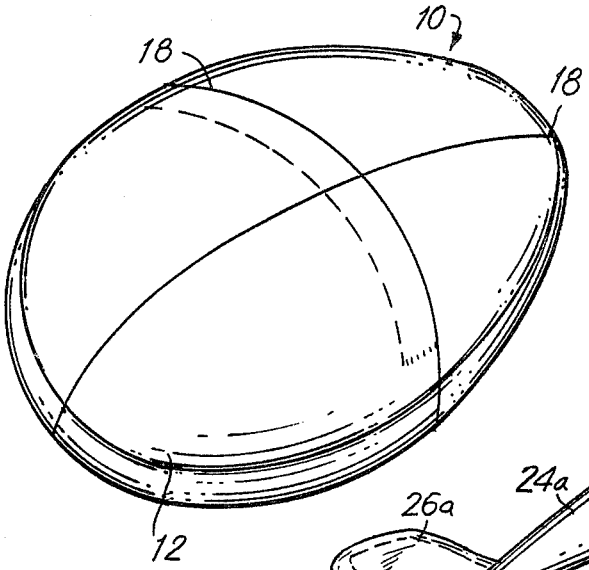
FIG. 1 is a perspective view of the toy shown in its first configuration which is generally egg-shaped.

Referring now specifically to the drawing, in accordance with one illustrative embodiment demonstrating objects and features of the present invention, there is provided a three dimensional toy, generally designated by the reference numeral 10 which includes juxtaposed first and second surfaces, the first juxtaposed surface being designated by the reference numeral 12 and the second juxtaposed surface being designated by the reference numeral 14. The surfaces 12, 14 are constituted of any appropriate pliable material and preferably are constituted of fabric.

The second surface 14 has affixed thereto a plurality of figure-forming elements 16. The figure-forming elements 16 are preferably constituted of a pliable fabric material. The figure-forming elements 16 may be attached to second surface 14 in any appropriate manner and in the preferred embodiment figure-forming elements 16 are sewn to second surface 14.

A means defining an opening 18 is provided through both the first and second surfaces 12, 14. The means defining an opening 18 in a preferred embodiment is a discontinuity in said surfaces 12, 14 which preferably extends more than halfway around the toy 10.

Figure 2:
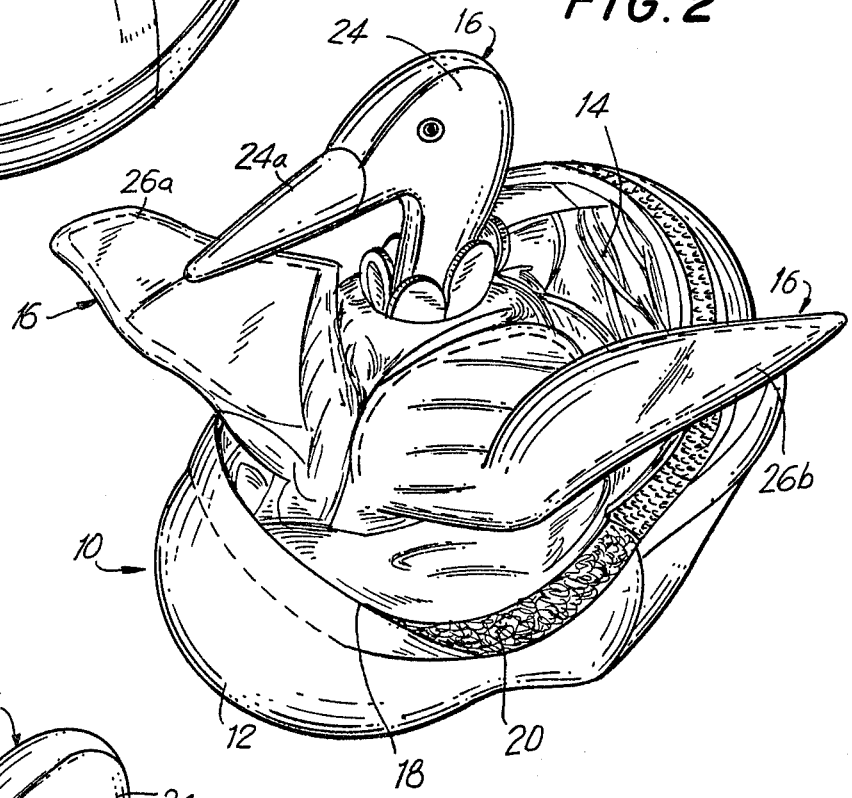
FIG. 2 is a perspective view of the toy shown during the transformation of same from its first to its second configuration.
Figure 3:
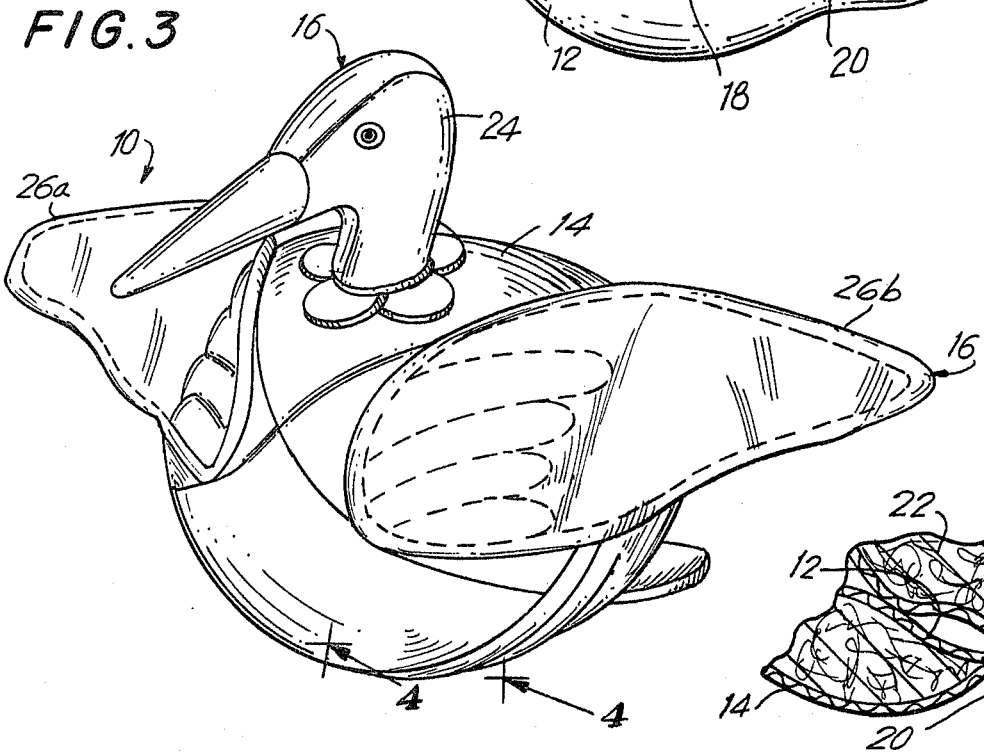
FIG. 3 is a perspective view of the toy shown in its second configuration.
Figure 5:
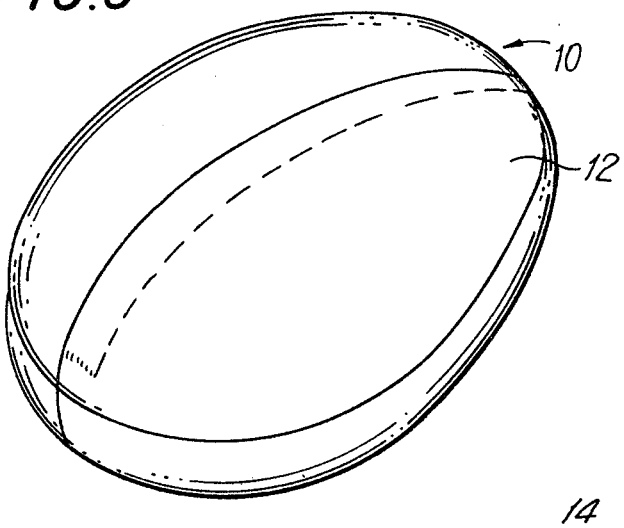
FIG. 5 is a view analogous to FIG. 1 showing another preferred embodiment of the invention while in its first configuration which is generally egg-shaped.
Figure 6:
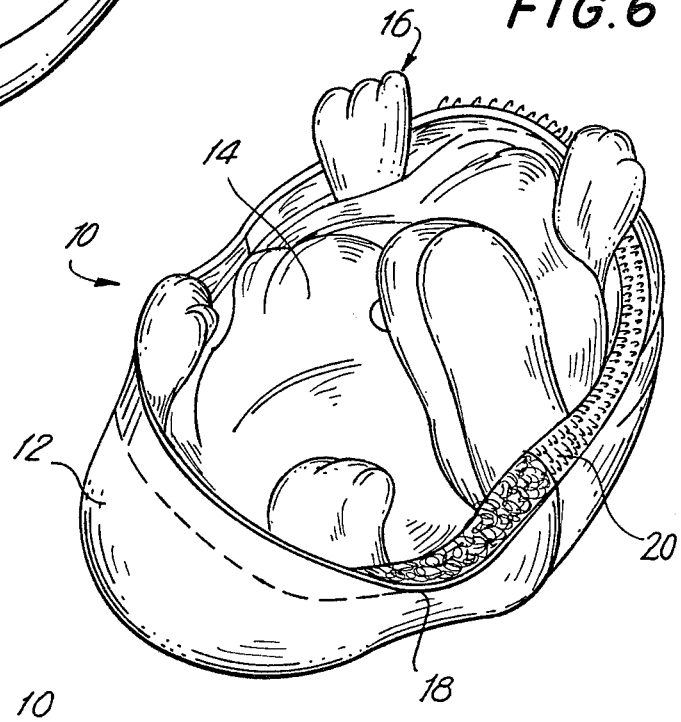
FIG. 6 is a view analogous to FIG. 2 showing another preferred embodiment of the invention during the transformation of same from its first to its second configuration.
Figure 7:
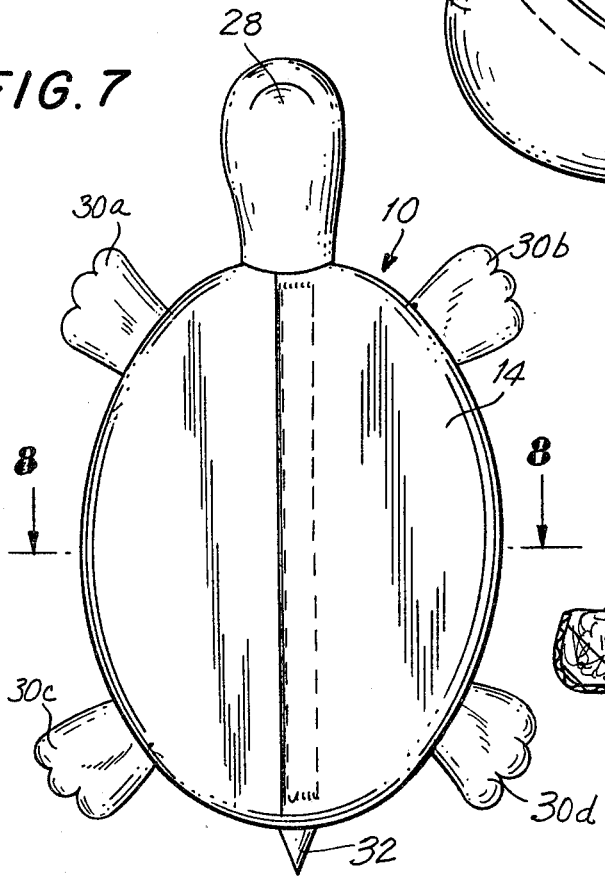
FIG. 7 is a top plan view of an embodiment of the toy shown in its second configuration.

The toy 10 is transformable from a first configuration, best shown in FIGS. 1 and 5, to a second configuration, best shown in FIGS. 3 and 7. The toy is capable of assuming an infinite number of configurations intermediate said first and said second configurations, FIGS. 2 and 6 exemplify intermediate configurations. In its first configuration, the toy 10 is a closed ovoid resembling an egg. In this first configuration, the first surface 12 is positioned on the outside of the toy 10 and the second surface 14 with its affixed figure-forming elements 16 is hidden from view in said first surface 12. In its second configuration, the toy 10 resembles a fanciful figure. While in this second configuration, the first surface 12 is located within the toy 10 and the second surface 12 with its affixed figure-forming elements 16 is positioned outwardly from the first surface 12 and exposed to view.

As shown in the drawing, when the toy 10 is in either its first or its second configuration, the means for defining an opening 18 is closed. When the toy 10 is being transformed from its first to its second configuration, the means for defining opening 18 is open.

The toy 10 is transformed from its first to its second configuration by passing the bulk of the toy through the means for defining an opening 18. This transformation is easily performable by a child. The child by transforming the toy 10 from the first to the second configuration provides himself with a source of entertainment, amusement and education.

The means for defining an opening 18 may be provided with closing means 20 attached thereto for closing same. The closing means 20 may be constituted of any appropriate material, and in one embodiment of toy 10 the closing means 20 is constituted of matable velcro strips.

Figure 4:
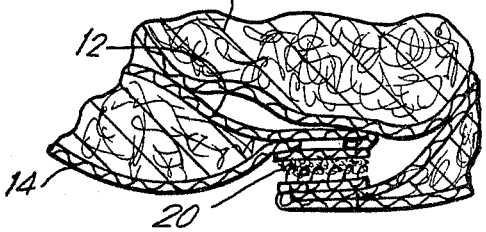
FIG. 4 is a sectional view taken generally along line 4—4 of FIG. 3.
Figure 8:
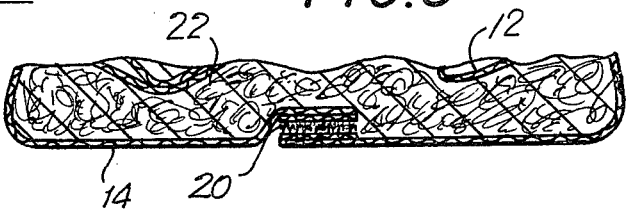
FIG. 8 is a sectional view taken generally along line 8—8 of FIG. 7.

The figure-forming elements 16, as shown in FIGS. 4 and 8, may contain filling material 22. The filling material 22 provides the toy 10 with additional bulk. In addition, filling material similar to filling material 22 may be contained between the first surface and second surface 14 to add more bulk or substance to the toy 10.

The figure-forming elements 16 may be shaped and dimensioned such that the toy 10 resembles any fanciful figure. Preferably figure-forming elements 16 are shaped and dimensioned such that the toy 10 in its second configuration resembles an animal which is normally hatched from an egg. In one preferred embodiment best shown in FIGS. 2 and 3, the figure-forming elements 16 are shaped and dimensioned such that the toy when in its second configuration resembles a duck. The duck-like fanciful figure is created by providing the toy 10 with a head 24 shaped and dimensioned to resemble a duck's head. Head 24 has a bill **24*a* thereon to further enhance the toy's duck-like look. Additionally, figure-forming elements 26*a* and 26*b*** are included and are formed to resemble duck's wings. The figure-forming elements work together to create a cute, appealing, fanciful duck-like animal.

In another embodiment, best shown in FIGS. 6 and 8, the figure-forming elements 16 are shaped and dimensional such that the toy 10 resembles a turtle-like animal when in its second configuration. The turtle-like animal is created by providing figure-forming element 28 which is shaped and dimensioned to resemble a turtle's head and by providing figure-forming elements **30*a*, 30*b*, 30*c* and 30*d* which are shaped and dimensioned to resemble turtle's feet. Figure-forming element 32** is also included and is shaped and dimensioned to resemble a turtle's tail.

The toy 10 may be of any color, but preferably a variety of colors that are appealing to a small child are used. Preferably, the figure-forming elements 16 and the surfaces 12 and 14 are of different colors.

As will be readily apparent to those skilled in the art, the invention may be used in other specific forms or for other purposes without departing from its spirit or central characteristic. The present embodiments are therefore to be considered as illustrative and not restrictive, the scope of the invention being indicated by the claims rather than by the foregoing description, and all changes which come within the meaning and range of equivalents of the claims are therefore intended to be embraced therein.

What is claimed is:

1. A three-dimensional toy comprising:

(a) juxtaposed first and second surfaces, said first surface defining a complete outer surface of said toy in a first configuration, said second surface defining a complete outer surface of said toy in a second configuration, said juxtaposed first and second surfaces having means defining an opening therethrough;

(b) a plurality of figure-forming elements affixed to only said second surface such that in the second configuration said toy forms a fanciful figure, said figure forming elements being related to each other and having multiple surfaces which extend outwadly from the bulk of the toy such that the second surface of the toy is complex;

(c) said first surface being devoid of any figure forming elements such that the first surface is simple and smooth, said toy in said first configuration forming an egg from which said fanciful figure of the second configuration hatches; and (d) said toy transformable from said first configuration to said second configuration, said transformation being performed by causing the bulk of said toy to pass through said means for defining an opening, said toy when in said first configuration being such that said first surface is on the outside of said toy and said second surface is completely hidden from view within said first surface, said second configuration being such that said first surface is located completely within said toy and said second surface is positioned outwardly from said first surface and exposed to view, said means for defining an opening being closed when said toy is in either said first or said second configuration, and being opened during said transformation, said figure-forming elements being exposable when said toy is being transformed from said first configuration to said second configuration and vice-versa such that said two surfaces and said two configurations are inter-related to one another, and said figure-forming elements changing in shape during said transformation, said transformable toy being approximately the same size in both said first and said second configurations.

2. The toy of claim 1 wherein said surfaces are constituted of fabric.

3. The toy of claim 1 and additionally comprising filling material contained within said figure-forming elements.

4. The toy of claim 1 and additionally comprising filling material contained between said first and second surfaces.

5. The toy of claim 1 and additionally comprising closing means attached to said means for defining an opening for closing same.

6. The toy of claim 1 wherein said plurality of figure-forming elements are shaped and dimensioned such that said toy resembles a duck when in said second configuration.

7. The toy of claim 1 wherein said figure-forming elements are shaped and dimensioned such that said toy resembles a turtle when in said second configuration.

8. The toy of claim 1 wherein the toy is capable of assuming an infinite number of configurations intermediate said first and said second configurations.

* * * * *